US008516644B2

(12) United States Patent
Witzel et al.

(10) Patent No.: US 8,516,644 B2
(45) Date of Patent: Aug. 27, 2013

(54) BARBECUE GRILL CLEANER WITH BARRIER FLAP

(75) Inventors: Terry Witzel, Waterloo (CA); Benjamin Harrison, Waterloo (CA); Christian Robinson, Kitchener (CA)

(73) Assignee: Onward Multi-Corp Inc., Waterloo, Ontario (CA)

( * ) Notice: Subject to any disclaimer, the term of this patent is extended or adjusted under 35 U.S.C. 154(b) by 0 days.

(21) Appl. No.: 13/231,641

(22) Filed: Sep. 13, 2011

(65) Prior Publication Data

US 2013/0061411 A1 Mar. 14, 2013

(51) Int. Cl.
*A47L 13/12* (2006.01)
*A47L 17/00* (2006.01)

(52) U.S. Cl.
USPC ..... 15/160; 15/111; 15/117

(58) Field of Classification Search
USPC ..... 15/117, 160, 111
See application file for complete search history.

(56) References Cited

U.S. PATENT DOCUMENTS

| | | | | | |
|---|---|---|---|---|---|
| 75,421 | A | * | 3/1868 | Howard | 15/117 |
| 96,219 | A | * | 10/1869 | Gibson | 15/117 |
| 106,196 | A | * | 8/1870 | Odell | 15/117 |
| 109,946 | A | * | 12/1870 | Rockwell | 15/117 |
| 3,196,473 | A | | 7/1965 | Bell | |
| 4,091,579 | A | * | 5/1978 | Giangiulio | 451/461 |
| 5,373,600 | A | | 12/1994 | Stojanovski et al. | |
| 6,463,619 | B2 | * | 10/2002 | Gavney, Jr. | 15/117 |
| D567,510 | S | | 4/2008 | Tuli | |

* cited by examiner

*Primary Examiner* — Randall Chin
(74) *Attorney, Agent, or Firm* — Bereskin & Parr LLP

(57) ABSTRACT

A barbecue grill cleaner, including a head member having a front end and a rear end, a cleaning element coupled to the head member and extending downwardly therefrom, and a barrier flap. The barrier flap is coupled to the head member and extends downwardly therefrom, the barrier flap being formed of a flexible and resilient material and positioned rearwardly relative to the cleaning element. The barrier flap is configured to obstruct debris that is projected rearwardly by the cleaning element.

20 Claims, 7 Drawing Sheets

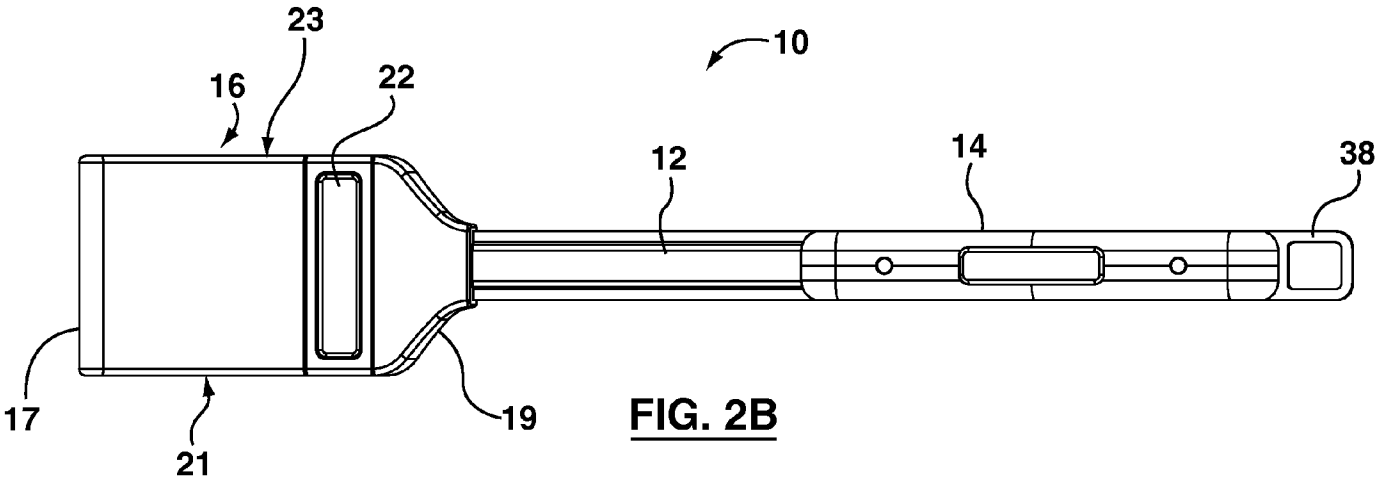
FIG. 2B
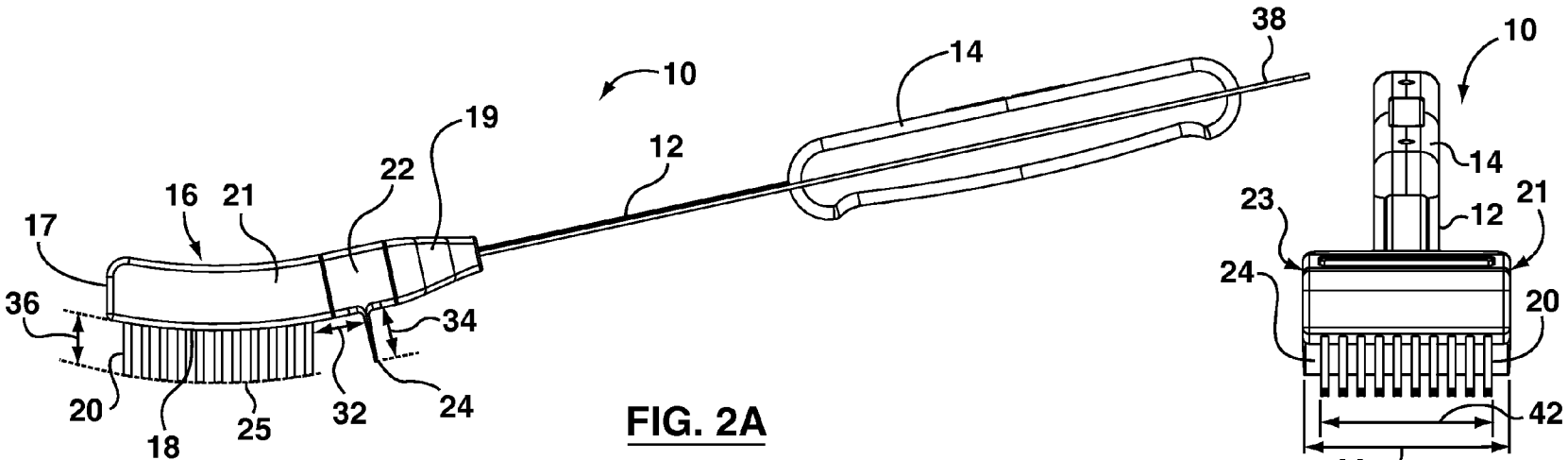
FIG. 2A
FIG. 2C

BARBECUE GRILL CLEANER WITH BARRIER FLAP

FIELD

This specification relates to devices for cleaning barbecue grills and the like.

INTRODUCTION

When a barbecue is used for heating food, the barbecue grill may become dirty from food debris that remains after cooking. A barbecue grill cleaner can be used to remove the food debris. For example, a barbecue grill brush can be a hand-held unit that is passed over the barbecue grill to scrub and scrape away food debris.

SUMMARY OF SOME EMBODIMENTS

In an aspect of this specification, a barbecue grill cleaner, comprising: a head member having a front end and a rear end, a cleaning element coupled to the head member and extending downwardly therefrom, and a barrier flap coupled to the head member and extending downwardly therefrom, the barrier flap being formed of a flexible and resilient material and positioned rearwardly relative to the cleaning element, the barrier flap configured to obstruct debris that is projected rearwardly by the cleaning element.

According to another aspect of the specification, a barbecue grill cleaner, comprising: a handle, a head member having a front end and a rear end, the rear end coupled to the handle, a cleaning element coupled to the head member and extending downwardly therefrom, and a barrier flap coupled to the head member and extending downwardly therefrom, the barrier flap being formed of a flexible and resilient material and positioned between the cleaning element and the handle, the barrier flap configured to obstruct debris that is projected rearwardly by the cleaning element.

According to yet another aspect of the specification, a cleaner for a grill, comprising: a head member having a front end and a rear end, and including a recessed portion adjacent to the rear end, a cleaning element coupled to the head member and extending downwardly therefrom, an attachment sleeve received onto the recessed portion of the head member, and a barrier flap mounted to the attachment sleeve and extending downwardly therefrom, the barrier flap being formed of a flexible and resilient material and positioned between the cleaning element and the handle, the barrier flap configured to obstruct debris that is projected rearwardly by the cleaning element.

Other aspects and features of the teachings disclosed herein will become apparent, to those ordinarily skilled in the art, upon review of the following description of the specific examples of the specification.

BRIEF DESCRIPTION OF THE DRAWINGS

The drawings included herewith are for illustrating various examples of articles, methods, and apparatuses of the present specification and are not intended to limit the scope of what is taught in any way. In the drawings:

FIGS. 2A, 2B and 2C are side, top and front views, respectively, of the barbecue grill cleaner of FIG. 1;

DETAILED DESCRIPTION OF SOME EMBODIMENTS

Figure 1:
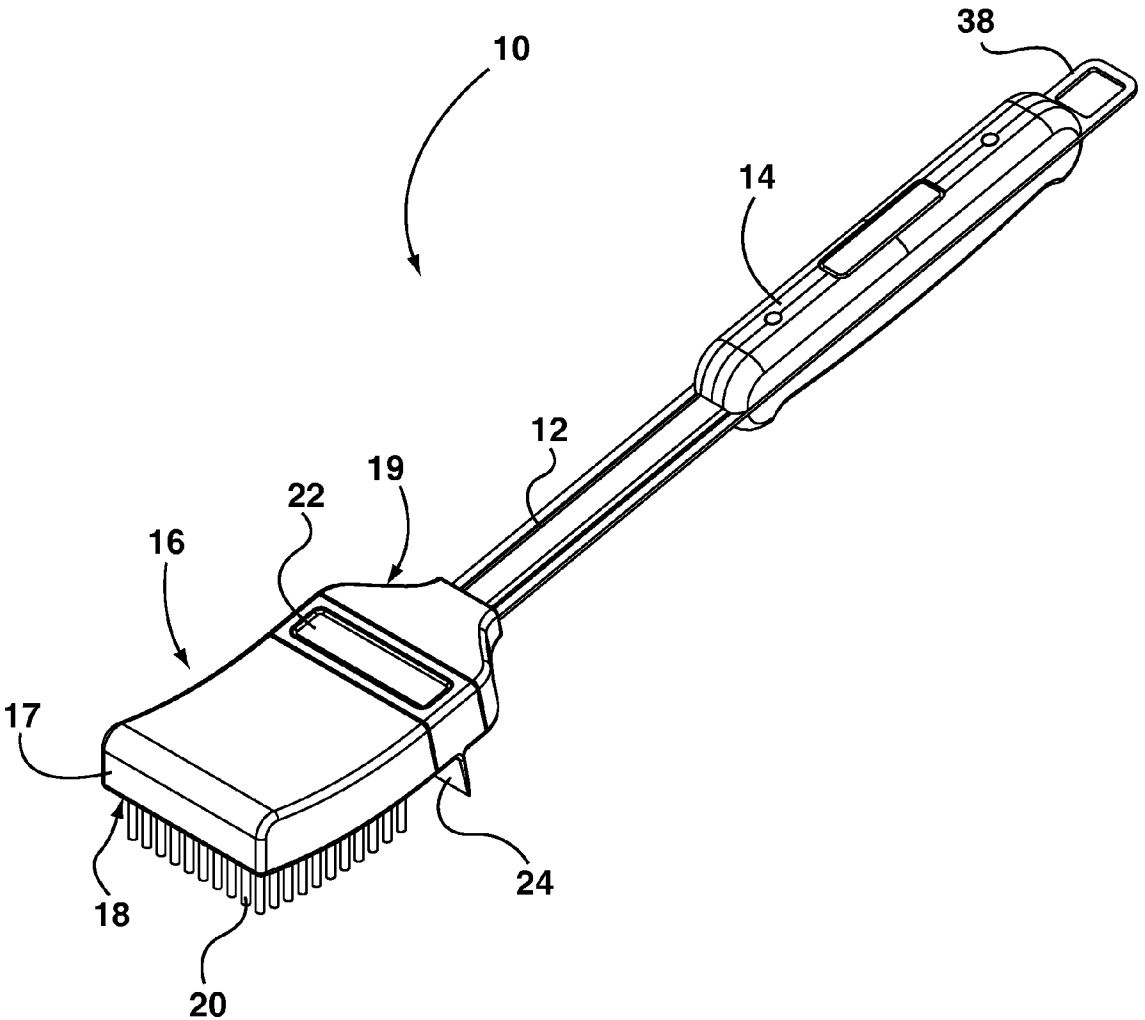
FIG. 1 is an upper perspective view of a barbecue grill cleaner with a barrier flap.

It will be appreciated that for simplicity and clarity of illustration, where considered appropriate, reference numerals may be repeated among the figures to indicate corresponding or analogous elements. In addition, numerous specific details are set forth in order to provide a thorough understanding of the examples embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limited to the scope of the example embodiments described herein.

Reference is now made to FIG. 1, in which an example of a barbecue grill cleaner is illustrated generally at 10. Barbecue grill cleaner 10 includes an elongate handle 12, a gripping element 14 secured to the handle 12, and a head member 16. Head member 16 has a front end 17 and a rear end 19 opposite from front end 17, and includes a grill facing surface 18 extending generally between front and rear ends 17, 19. A cleaning element 20 is coupled to head member 16 and extends downwardly from grill facing surface 18. An attachment sleeve 22 is coupled to head member 16. A barrier flap 24 is mounted to attachment sleeve 22 and extends downwardly therefrom. Barrier flap 24 is positioned rearwardly relative to cleaning element 20.

Barbecue grill cleaner 10 can be used to clean a cooking surface, for example, a barbecue grill (not shown), by removing food debris. In use, a user (not shown) holds gripping element 14 of handle 12, with the user positioned aft of head member 16 in a position in proximity to gripping element 14 of handle 12, and directs cleaning element 20 to pass over the cooking surface in a back-and-forth motion to remove debris. Occasionally, cleaning element 20 can project debris being scraped from the cooking surface generally rearwardly towards the user. Barrier flap 24 is configured to obstruct debris that is projected by cleaning element 20. In the example illustrated, barrier flap 24 is disposed generally between cleaning element 20 and gripping element 14 of handle 12.

In some examples, barrier flap 24 can be formed of a flexible and resilient material. As used herein, the terms flexible and resilient refer to the ability of a material to be elastically deformed, but tend to return to its original state. Each of head member 16, attachment sleeve 22 and barrier flap 24 can be formed of a heat-resistant material suitable for withstanding relatively high temperatures of the cooking surface, for example, a heat-resistant polymer, such as silicone rubber.

In the example illustrated, cleaning element 20 consists of a plurality of bristles, arranged generally in bundles and fixed securely to grill facing surface 18 of head member 16. Each of the bristles can be formed of, for example, brass wire, stainless steel wire, or nylon fibers.

It should be appreciated that barbecue grill cleaner 10 can include additional features, for example, an end loop 38 for hanging, a metal scraper (not shown), a notched scraper (not shown), and a bottle opener (not shown).

Referring to FIGS. 2A, 2B and 2C, grill facing surface 18 can be convexly curved between front and rear ends 17, 19. Cleaning element 20 can have a bottom curvature 25 that is generally complementary to grill facing surface 18.

Barrier flap 24 is positioned to obstruct debris that is projected by cleaning element 20. In the example illustrated, barrier flap 24 is displaced rearwardly relative to cleaning element 20 a displacement dimension 32. Furthermore, barrier flap 24 is sized such that barrier flap 24 does not interfere substantially with operation of cleaning element 20. In the example illustrated, barrier flap 24 has a height dimension 34, and cleaning element 20 has a height dimension 36. It should be noted that, due to the curvature of grill facing surface 18 in the example illustrated, displacement dimension 32 can be measured immediately adjacent to grill facing surface 18, whereas height dimensions 34, 36 can be defined as being orthogonal relative to grill facing surface 18.

Displacement dimension 32 and height dimension 34 can be selected so as to generally optimize the efficacy of barrier flap 24 in obstructing debris that is projected rearwardly by cleaning element 20, while at the same time ensuring that barrier flap 24 does not interfere substantially with operation of cleaning element 20. In the example illustrated, displacement dimension 32 is approximately equal to height dimension 36 of cleaning element 20, and height dimension 34 of barrier flap 24 is less than or equal to height dimension 36 of cleaning element 20.

Barrier flap 24 extends laterally between a first side 21 and a second side 23 of head member 16. Barrier flap 24 can have a width dimension 44 that is greater than a width dimension 42 of cleaning element 20 (FIG. 2C).

Figure 3A:
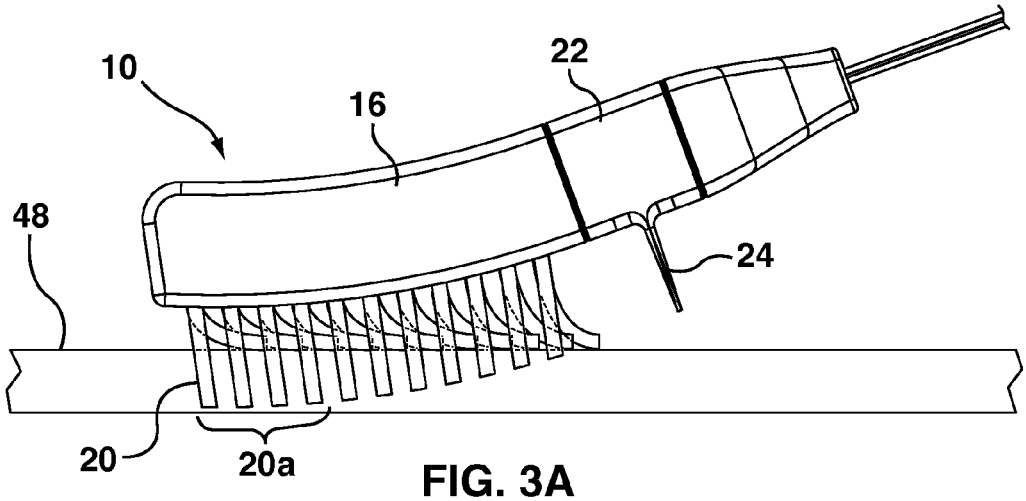
FIGS. 3A, 3B and 3C are enlarged partial side views of the barbecue grill cleaner of FIG. 1 in inclined, intermediate and declined positions, respectively, relative to a cooking surface.
Figure 3B:
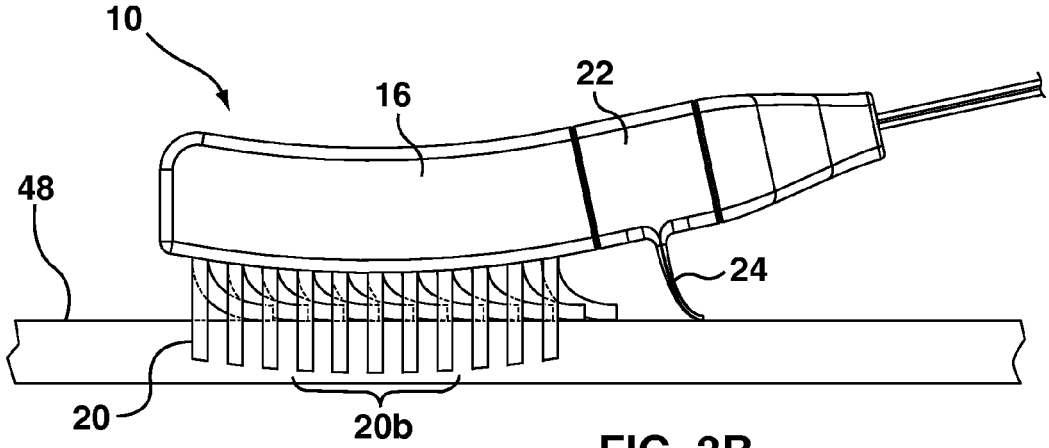
Figure 3C:
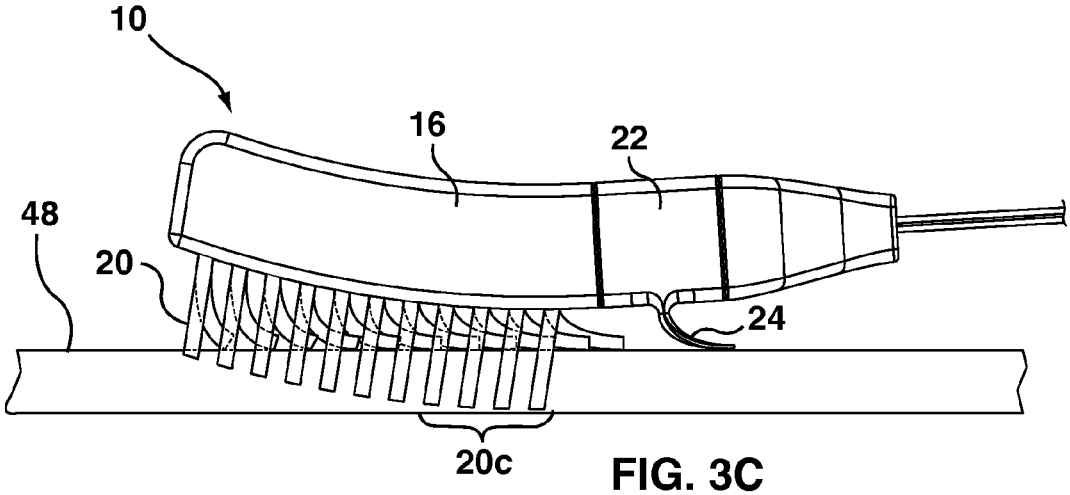

FIGS. 3A, 3B and 3C show barbecue grill cleaner 10 in use with a cooking surface 48.

In FIG. 3A, barbecue grill cleaner 10 is shown at an inclined angle relative to cooking surface 48. Due to curvature of head member 16 and cleaning element 20, a forward portion 20*a* of cleaning element 20 achieves greatest depth of penetration into cooking surface 48. Despite a relatively small gap between barrier flap 24 and cooking surface 48, barrier flap 24 is positioned close enough relative to cleaning element 20 to obstruct much of the debris that may be projected rearwardly by cleaning element 20.

In FIG. 3B, barbecue grill cleaner 10 is shown at an intermediate angle relative to cooking surface 48, in which a central portion 20*b* of cleaning element 20 achieves greatest depth of penetration into cooking surface 48. Barrier flap 24 is shown deflecting slightly to conform to cooking surface 48, but is not impairing operation of cleaning element 20.

In FIG. 3C, barbecue grill cleaner 10 is shown at a declined angle relative to cooking surface 48, in which a rearward portion 20*c* of cleaning element 20 achieves greatest depth of penetration into cooking surface 48. As shown, rearward displacement of barrier flap 24 relative to rearward portion 20*c* of cleaning element 20 ensures that barrier flap 24 does not interfere with operation of cleaning element 20.

FIGS. 3A, 3B and 3C represent a natural range of motion of barbecue grill cleaner 10 in use. Although a push motion is depicted, it should be appreciated that barbecue grill cleaner 10 can also be utilized with a pulling motion, or a side-to-side motion, or any combination thereof.

Figure 4C:
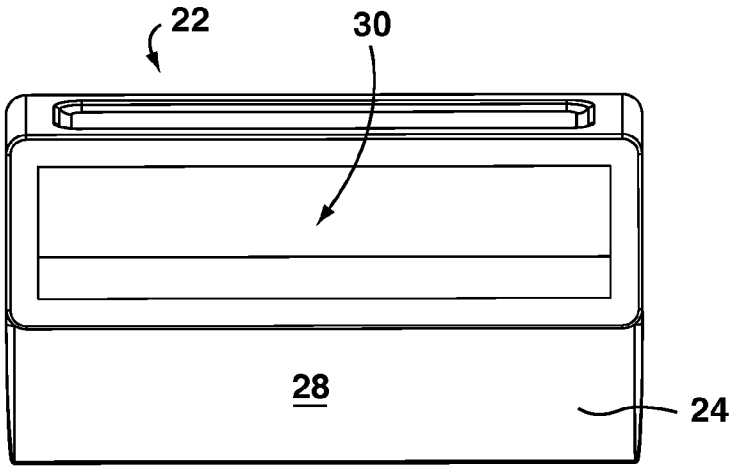
FIGS. 4A, 4B and 4C are side, lower perspective and front views, respectively, of an attachment sleeve and the barrier flap of FIG. 1.
Figure 4A:
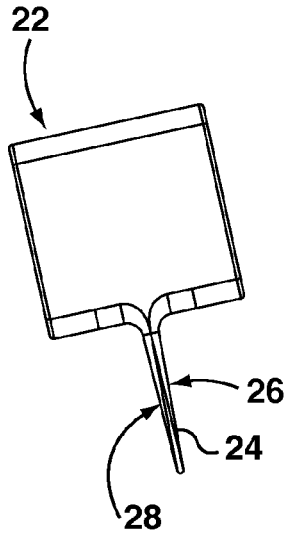
Figure 4B:
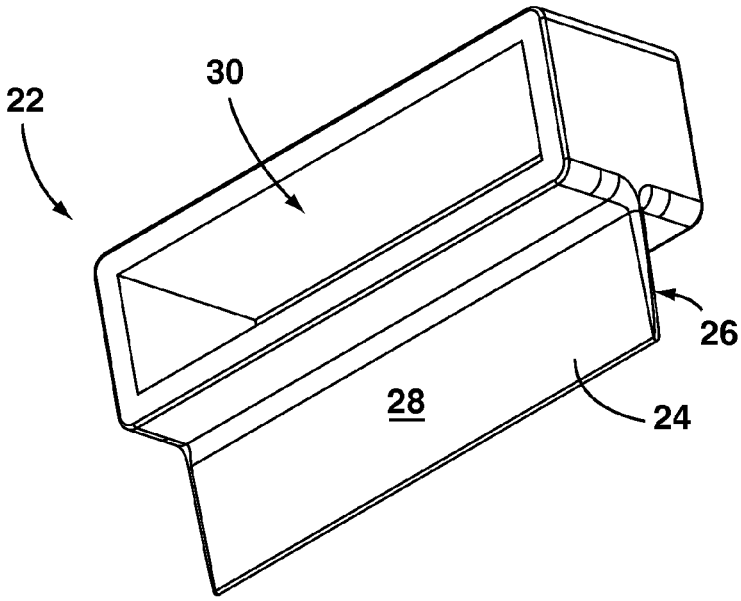

Attachment sleeve 22 is shown in greater detail in FIGS. 4A, 4B and 4C. Attachment sleeve 22 includes a central cavity 30 that is shaped to receive and circumferentially engage head member 16 when barbecue grill cleaner 10 is assembled (FIG. 1). In the example illustrated, barrier flap 24 is integrally formed with attachment sleeve 22. In other examples, attachment sleeve 22 and barrier flap 24 can be separate elements.

Barrier flap 24 extends downwardly from attachment sleeve 22, and includes rearward and forward facing surfaces 26, 28 on generally opposing sides. Forward facing surface 28 faces cleaning element 20, and can be generally planar and generally orthogonal to grill facing surface 18 (FIG. 2A). Barrier flap 24 can have a variable thickness between rearward and forward facing surfaces 26, 28. In the example illustrated, thickness of barrier flap 24 progressively decreases away from attachment sleeve 22.

Figure 5A:
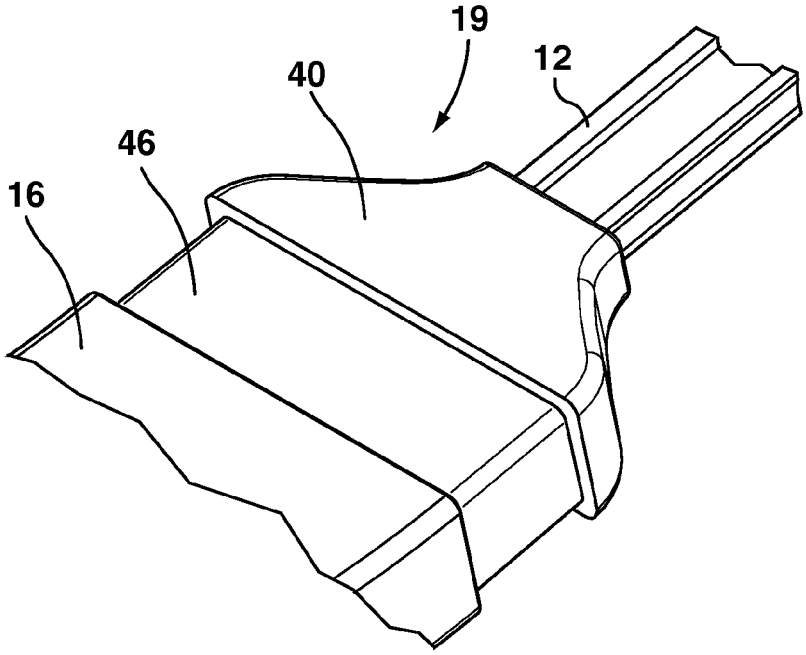
FIGS. 5A and 5B are enlarged partial upper perspective views of the barbecue grill cleaner of FIG. 1, without and with the barrier flap, respectively.
Figure 5B:
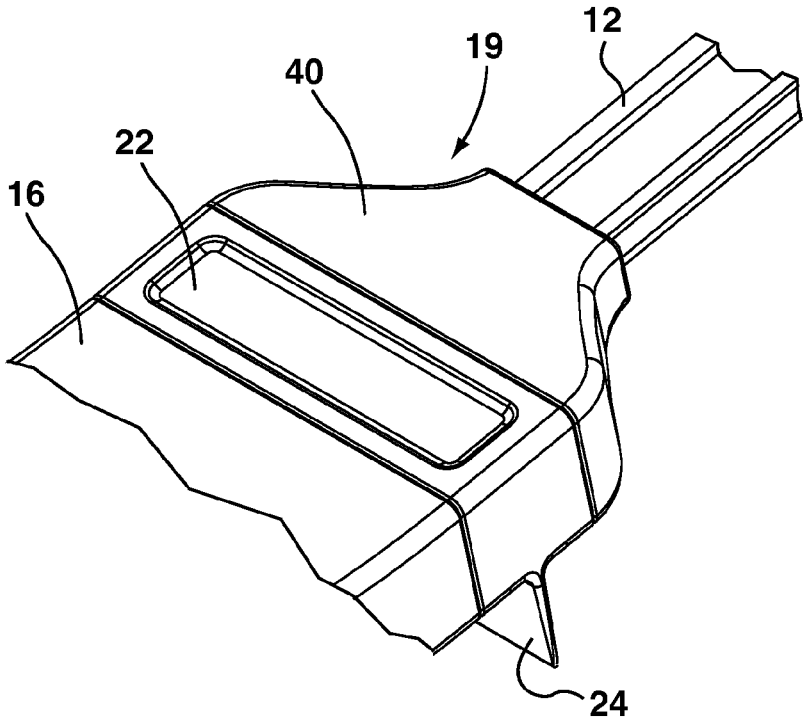

Referring to FIGS. 5A and 5B, head member 16 includes recessed portion 46 adjacent to rear end 19. Attachment sleeve 22 is sized and shaped to be received onto and circumferentially engage recessed portion 46 (FIG. 5B). Head member 16 further includes a neck portion 40 at rear end 19. Neck portion 40 is secured to handle 12.

Figure 6C:
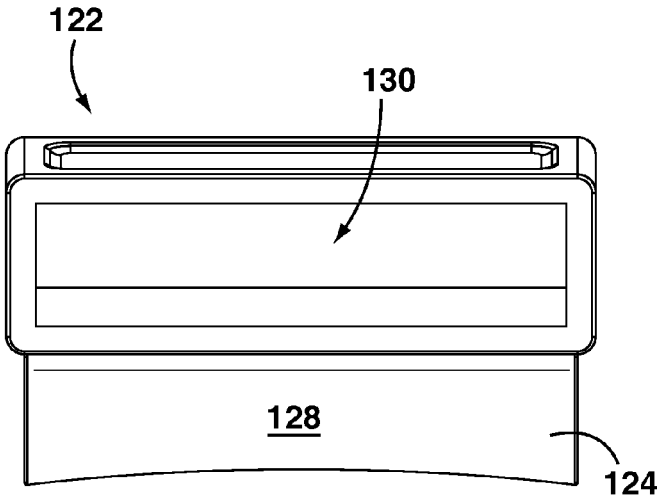
FIGS. 6A, 6B and 6C are side, lower perspective and front views, respectively, of another attachment sleeve and barrier flap.
Figure 6A:
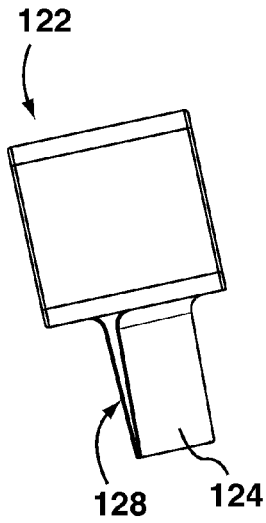
Figure 6B:
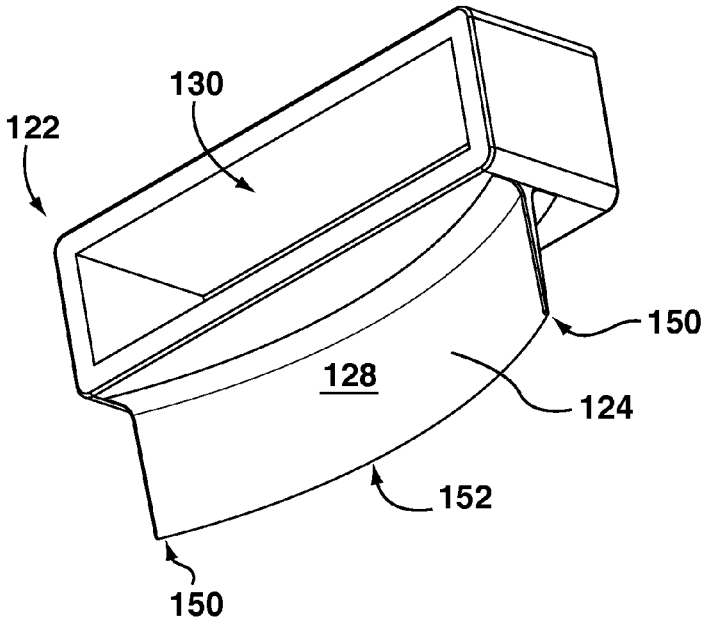

Referring now to FIGS. 6A, 6B and 6C, another example of an attachment sleeve is illustrated generally at 122. Attachment sleeve 122 includes a central cavity 130, and a barrier flap 124. Barrier flap 124 has a forward facing surface 128 that is generally arcuate, such that, when barbecue grill cleaner 10 is assembled, lateral ends 150 of forward facing surface 128 are closer in proximity to cleaning element 20 than a middle section 152 of forward facing surface 128. With an arcuate configuration, barrier flap 124 can be more rigid than barrier flap 24 with a planar configuration.

Figure 7A:
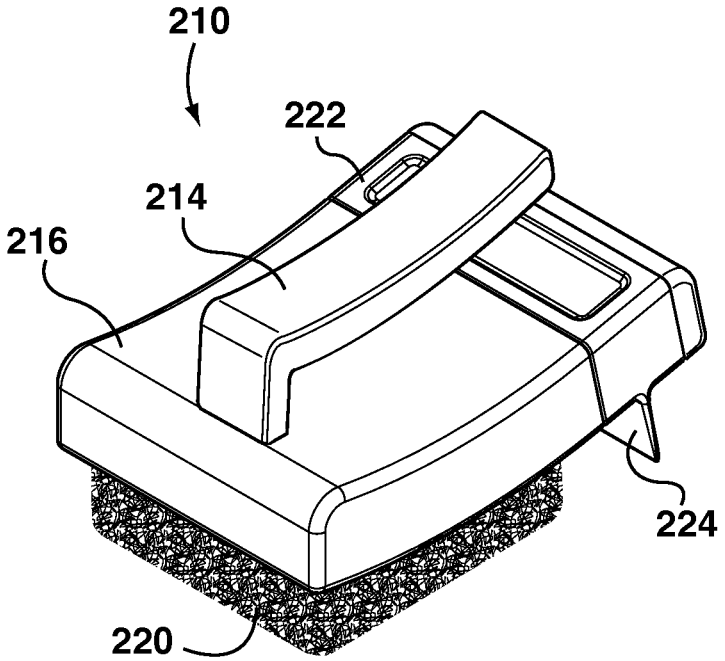
FIGS. 7A and 7B are upper perspective and side views, respectively, of another barbecue grill cleaner with a barrier flap.
Figure 7B:
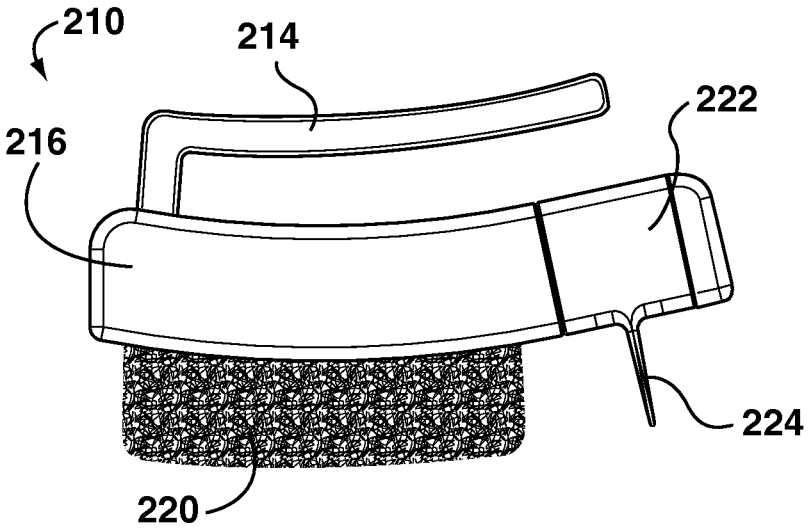

Referring now to FIGS. 7A and 7B, another example of a barbecue grill cleaner is illustrated generally at 210. Barbecue grill cleaner 210 includes a handle 214 coupled directly to a head member 216. A cleaning element 220 extends downwardly from head member 216. In the example illustrated, cleaning element 220 takes the form of an abrasive element, which can be, for example, a replaceable scouring pad. An attachment sleeve 222 is coupled to head member 216. A barrier flap 224 is mounted to attachment sleeve 222 and extends downwardly therefrom. Barrier flap 224 is configured to obstruct debris that is projected rearwardly by cleaning element 220.

While the above description provides examples of one or more processes or apparatuses, it will be appreciated that other processes or apparatuses may be within the scope of the accompanying claims.

The invention claimed is:

1. A barbecue grill cleaner, comprising:

a head member having a front end and a rear end, and including a grill facing surface that extends generally between the front and rear ends, the grill facing surface being generally convexly curved between the front and rear ends;

a cleaning element coupled to the head member and extending downwardly from the grill facing surface; and a barrier flap coupled to the head member and extending downwardly from the grill facing surface, the barrier flap being formed of a flexible and resilient material and positioned rearwardly relative to the cleaning element, the barrier flap configured to obstruct debris that is projected rearwardly by the cleaning element, wherein the barrier flap is displaced rearwardly relative to the cleaning element by a displacement dimension that is approximately equal to a height dimension of the cleaning element.

2. The barbecue grill cleaner of claim 1, wherein a height dimension of the barrier flap is less than or equal to a height dimension of the cleaning element.

3. The barbecue grill cleaner of claim 1, wherein the barrier flap extends laterally between first and second sides of the head member.

4. The barbecue grill cleaner of claim 3, wherein a width dimension of the barrier flap is greater than a width dimension of the cleaning element.

5. The barbecue grill cleaner of claim 1, wherein the cleaning element has a bottom curvature that is generally complementary to the convexly curved grill facing surface.

6. The barbecue grill cleaner of claim 1, wherein the barrier flap comprises a forward facing surface that is generally orthogonal to the grill facing surface of the head member.

7. The barbecue grill cleaner of claim 6, wherein the forward facing surface is generally planar.

8. The barbecue grill cleaner of claim 6, wherein the forward facing surface is generally arcuate, such that lateral ends of the forward facing surface are arranged nearer to the cleaning element than a middle section of the forward facing surface.

9. The barbecue grill cleaner of claim 1, further comprising an attachment sleeve coupled to the head member, and wherein the barrier flap is mounted to the attachment sleeve and extends downwardly therefrom.

10. The barbecue grill cleaner of claim 9, wherein the barrier flap is integrally formed with the attachment sleeve.

11. The barbecue grill cleaner of claim 10, wherein the head member comprises a recessed portion, and the attachment sleeve comprises a central cavity that receives the recessed portion of the head member.

12. The barbecue grill cleaner of claim 11, wherein the central cavity of the attachment sleeve is sized and shaped to circumferentially engage the recessed portion.

13. The barbecue grill cleaner of claim 9, wherein the head member comprises a recessed portion, and the attachment sleeve is adapted to be received into the recessed portion.

14. The barbecue grill cleaner of claim 13, wherein the attachment sleeve is sized and shaped to circumferentially engage the recessed portion.

15. The barbecue grill cleaner of claim 1, further comprising a handle coupled to the head member, the barrier flap being positioned generally between the cleaning element and the handle.

16. A barbecue grill cleaner, comprising:

a handle;

a head member having a front end and a rear end, the rear end being coupled to the handle, the head member including a grill facing surface that extends generally between the front and rear ends, the grill facing surface being generally convexly curved between the front and rear ends;

a cleaning element coupled to the head member and extending downwardly from the grill facing surface; and a barrier flap coupled to the head member and extending downwardly from the grill facing surface, the barrier flap being formed of a flexible and resilient material and positioned between the cleaning element and the handle, the barrier flap configured to obstruct debris that is projected rearwardly by the cleaning element.

17. The barbecue grill cleaner of claim 16, wherein the barrier flap is displaced rearwardly relative to the cleaning element by a displacement dimension that is approximately equal to a height dimension of the cleaning element.

18. The barbecue grill cleaner of claim 17, wherein a height dimension of the barrier flap is less than or equal to a height dimension of the cleaning element.

19. The barbecue grill cleaner of claim 18, wherein the barrier flap extends laterally between first and second sides of the head member, and a width dimension of the barrier flap is greater than a width dimension of the cleaning element.

20. A cleaner for a grill, comprising:

a head member having a front end and a rear end, and including a recessed portion adjacent to the rear end, and a grill facing surface that extends generally between the front and rear ends, the grill facing surface being generally convexly curved between the front and rear ends;

a cleaning element coupled to the head member and extending downwardly from the grill facing surface;

an attachment sleeve received onto the recessed portion of the head member; and a barrier flap mounted to the attachment sleeve and extending downwardly therefrom, the barrier flap being formed of a flexible and resilient material and positioned rearwardly relative to the cleaning element, the barrier flap configured to obstruct debris that is projected rearwardly by the cleaning element.

* * * * *